US007938183B2

(12) United States Patent
Hart et al.

(10) Patent No.: US 7,938,183 B2
(45) Date of Patent: May 10, 2011

(54) METHOD FOR ENHANCING HEAVY HYDROCARBON RECOVERY

(75) Inventors: Paul Robert Hart, Sugar Land, TX (US); Brian J. Stefan, Calgary (CA); Piyush Srivastava, Houston, TX (US); Justin D. Debord, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 38 days.

(21) Appl. No.: 12/330,112

(22) Filed: Dec. 8, 2008

(65) Prior Publication Data

US 2009/0218099 A1 Sep. 3, 2009

Related U.S. Application Data

(60) Provisional application No. 61/032,297, filed on Feb. 28, 2008.

(51) Int. Cl.
*E21B 43/22* (2006.01)
*E21B 43/24* (2006.01)

(52) U.S. Cl. ..... 166/272.4; 166/272.3; 166/303; 208/391; 507/248; 507/250; 507/251

(58) Field of Classification Search ..... None
See application file for complete search history.

(56) References Cited

U.S. PATENT DOCUMENTS

| | | | | | |
|---|---|---|---|---|---|
| 3,221,813 | A | * | 12/1965 | Closmann et al. | 166/271 |
| 3,353,598 | A | * | 11/1967 | Smith | 166/245 |
| 3,464,492 | A | | 9/1969 | Friedman | |
| 3,782,472 | A | * | 1/1974 | Siess, Jr. | 166/303 |
| 3,961,018 | A | | 6/1976 | Williamson | |
| 4,156,463 | A | | 5/1979 | Hall | |
| 4,212,353 | A | * | 7/1980 | Hall | 166/303 |
| 4,270,609 | A | | 6/1981 | Choules | |
| 4,324,291 | A | * | 4/1982 | Wong et al. | 166/252.1 |
| 4,450,913 | A | | 5/1984 | Allen et al. | |
| 4,475,592 | A | | 10/1984 | Pachovsky | |
| 4,475,595 | A | * | 10/1984 | Watkins et al. | 166/272.3 |
| 4,513,819 | A | | 4/1985 | Islip et al. | |
| 4,522,732 | A | * | 6/1985 | Purcell et al. | 507/202 |
| 4,580,633 | A | | 4/1986 | Watkins et al. | |
| 4,607,699 | A | | 8/1986 | Stephens | |
| 4,706,751 | A | | 11/1987 | Gondouin | |
| 4,722,395 | A | | 2/1988 | Venkatesan | |
| 4,753,293 | A | | 6/1988 | Bohn | |
| 5,056,596 | A | | 10/1991 | McKay et al. | |
| 5,407,009 | A | | 4/1995 | Butler et al. | |
| 5,591,908 | A | | 1/1997 | Reid | |
| 5,607,016 | A | | 3/1997 | Butler | |
| 5,899,274 | A | | 5/1999 | Frauenfeld et al. | |
| 6,186,232 | B1 | | 2/2001 | Isaacs et al. | |
| 6,230,814 | B1 | | 5/2001 | Nasr et al. | |
| 6,318,464 | B1 | | 11/2001 | Mokrys | |
| 6,627,993 | B1 | | 9/2003 | Shen | |
| 6,769,486 | B2 | | 8/2004 | Lim et al. | |
| 6,883,607 | B2 | | 4/2005 | Nenniger et al. | |
| 7,077,201 | B2 | | 7/2006 | Heins | |
| 7,150,320 | B2 | | 12/2006 | Heins | |
| 2003/0127226 | A1 | | 7/2003 | Heins | |
| 2005/0072567 | A1 | * | 4/2005 | Steele et al. | 166/272.3 |
| 2006/0021506 | A1 | | 2/2006 | Hakka et al. | |
| 2006/0032630 | A1 | | 2/2006 | Heins | |
| 2006/0213657 | A1 | | 9/2006 | Berchanko et al. | |
| 2007/0034550 | A1 | | 2/2007 | Hedrick et al. | |
| 2007/0079964 | A1 | | 4/2007 | Shpakoff et al. | |
| 2009/0078414 | A1 | * | 3/2009 | Horvath Szabo et al. | 166/263 |

FOREIGN PATENT DOCUMENTS

| | | |
|---|---|---|
| WO | WO9632566 | 10/1996 |

* cited by examiner

*Primary Examiner* — George Suchfield
(74) *Attorney, Agent, or Firm* — Mossman, Kumar & Tyler, PC.

(57) ABSTRACT

Amines or ammonia and amines may be used to enhance recovery of heavy hydrocarbons. The amines or ammonia and amines alone or with water, steam or an oil solvent are combined with the heavy hydrocarbons to promote the transport of the heavy hydrocarbons. The amines or ammonia and amines may be injected downhole or admixed with heavy hydrocarbon containing ore on the surface, optionally with water or steam. Ammonia may be used alone with high quality steam.

16 Claims, No Drawings

METHOD FOR ENHANCING HEAVY HYDROCARBON RECOVERY

CROSS REFERENCE TO RELATED APPLICATIONS

The application claims priority from the U.S. Provisional Patent Application having the Ser. No. 61/032,297 which was filed on Feb. 28, 2008, the contents of which are fully incorporated herein by reference in their entirety.

BACKGROUND OF THE INVENTION

1. Field of the Invention

This invention relates to hydrocarbon production techniques. This invention particularly relates to heavy hydrocarbon production techniques employing steam.

2. Background of the Art

In some areas of the world there are large deposits of viscous or heavy crude oils and/or oil or tar sands which are located near the surface of the earth. The overburden in such areas may be nonextant but may also be as much as three hundred feet, or more. When the hydrocarbons are sufficiently shallow, the hydrocarbons may be effectively produced using strip mining or other bulk mining methods.

When hydrocarbons are too deep for bulk mining method, then the use of wells in combination with steam injection may be used to produce the hydrocarbons. One such method is known as steam flooding.

In steam flooding of an oil sand formation, for example, a pattern of wells is drilled vertically through the overburden and into the heavy oil sand, usually penetrating the entire depth of the sand. Casing is put in place and perforated in the producing interval and then steam generated at the surface is pumped under relatively high pressure down the casing and into the heavy oil formation.

In some instances the steam may be pumped for a while into all of the wells drilled into the producing formation and, after the heat has been used to lower the viscosity of the heavy oil near the well bore then the steam is removed and the heated, lowered viscosity, oil is pumped to surface, having entered the casing through the perforations. When the heat has dissipated and the heavy oil production falls off, the production is closed and the steam flood resumed. Where the same wells are used to inject steam for a while and then for production, this technique has been known as the huff and puff method or the push-pull method.

In other instances, some of the vertical wells penetrating the heavy oil sand are used to continuously inject steam while others are used to continuously produce lower viscosity oil heated by the steam. Again, when heavy oil production falls off due to lack of heat, the role of the injectors and producers can be reversed to allow injected steam to reach new portions of the reservoir and the process repeated.

In all of these production techniques, the steam flood is performed at a relatively high pressure (hundreds to over one thousand pounds per square inch or PSI) so as to allow it to penetrate as deeply into the production zone as possible.

One of the more advanced technologies for recovering heavy crude oil and bitumen is that of "Steam Assisted Gravity Drainage", or SAGD. In this method, two parallel horizontal oil wells are drilled in the formation. Each well pair is drilled parallel and vertically aligned with one another. They are typically about 1 kilometer long and 5 meters apart. The upper well is known as the "injection well" and the lower well is known as the "production well". The process begins by circulating steam in both wells so that the bitumen between the well pair is heated enough to flow to the lower production well. The freed pore space is continually filled with steam forming a "steam chamber". The steam chamber heats and drains more and more bitumen until it has overtaken the oil-bearing pores between the well pair. Steam circulation in the production well is then stopped and injected into the upper injection well only. The cone shaped steam chamber, anchored at the production well, now begins to develop upwards from the injection well. As new bitumen surfaces are heated, the oil's viscosity is reduced, allowing it to flow downward along the steam chamber boundary into the production well by way of gravity. Steam is always injected below the fracture pressure of the rock mass. Also, the production well is often throttled to maintain the temperature of the bitumen production stream just below saturated steam conditions to prevent steam vapor from entering the well bore and diluting oil production—this is known as the SAGD "steam trap".

The SAGD process typically recovers about 55% of the original bitumen-in-place. Other engineering parameters affecting the economics of SAGD production include the recovery rate, thermal efficiency, steam injection rate, steam pressure, minimizing sand production, reservoir pressure maintenance, and water intrusion.

SAGD offers a number of advantages in comparison with conventional surface mining extraction techniques and alternate thermal recovery methods. For example, SAGD offers significantly greater per well production rates, greater reservoir recoveries, reduced water treating costs and dramatic reductions in "Steam to Oil Ratio" (SOR).

The SAGD process is not entirely without drawbacks however; it requires some fresh water and large water re-cycling facilities and large amounts of natural gas to create the steam.

Relying upon gravity drainage, it requires comparatively thick and homogeneous reservoirs. Production rates are limited by the relatively high viscosity of bitumen, even hot. Derivative processes are being developed to increase production rates by adding volatile, bitumen-soluble solvents, such as condensable or non-condensable hydrocarbons, to the steam to lower the bitumen viscosity.

Conventional alkaline enhanced oil recovery agents, such as mineral hydroxides (eg. NaOH, KOH) and carbonates (e.g. NaHCO3, $Na_2CO_3$), can be carried to the oil bearing formation dissolved in any residual hot water in left in the produced steam, but are not volatile enough to be carried by steam alone. In the SAGD process in particular, there is a long and tortuous path through a sand-packed, dry, stream chamber to the water condensation/oil draining front, through which even the smallest water aerosol is unlikely to penetrate.

Certain volatile reagents, such as silanes, organosilicons, and ureas can enhance the recovery of light hydrocarbons by reacting with the surfaces of mineral fines or with the mineral formation itself to decrease the mobility of fines or water or otherwise improve permeability of oil through the formation. With oilsands in particular, however, the surface area of the mineral fines is so many times greater than that of the bitumen particles that any mineral or formation treating method becomes uneconomical. Moreover, the viscosity of heavy hydrocarbons like bitumen is so high that the conventional goal of decreasing water mobility and/or increasing oil permeability would actually retard the rate of bitumen production.

SUMMARY OF THE INVENTION

In one aspect, the present invention is a method of producing a hydrocarbon comprising contacting a hydrocarbon from a subterranean formation, in or ex situ, with steam and a volatile amine.

In another aspect, the present invention is an admixture of hydrocarbons and water and an amine or ammonia resulting from contacting a hydrocarbon from a subterranean formation, in or ex situ, with steam and a volatile amine.

In yet another aspect, the present invention is a method of producing a hydrocarbon comprising contacting a hydrocarbon from a subterranean formation, in or ex situ, with a solvent vapor, steam, and a volatile amine.

In another aspect, the present invention is an admixture of hydrocarbons, solvent, water, and an amine or ammonia resulting from contacting a hydrocarbon from a subterranean formation, in or ex situ, with a solvent vapor, steam, and a volatile amine.

In yet another aspect, the invention is a heavy hydrocarbon recovered from an underground formation resulting from contacting a hydrocarbon from a subterranean formation, in or ex situ, with a solvent vapor, steam, and a volatile amine or a volatile amine and ammonia.

Another aspect of the invention is a method for producing a hydrocarbon comprising contacting a heavy hydrocarbon from a subterranean formation, in or ex situ, with high quality steam and ammonia.

DETAILED DESCRIPTION OF THE PREFERRED EMBODIMENT

In one embodiment, the present invention is a method for producing a heavy hydrocarbon. For the purposes of this application, a heavy hydrocarbon includes dense or high viscosity crude oils and bitumen.

Heavy hydrocarbons can be difficult to produce. These hydrocarbons are very viscous and often cannot be produced using oil wells that are powered only by formation pressures. One method of lowering the viscosity of heavy hydrocarbons in subterranean formations is to flood the formation with steam. Steam increases the temperature of the hydrocarbons in the formation, which lowers their viscosity, allowing them to drain or be swept towards an oil well and be produced. Steam can also condense into water, which can then act as a low viscosity carrier phase for an emulsion of oil, thereby allowing heavy hydrocarbons to be more easily produced.

In one embodiment, the invention is a method of recovering heavy hydrocarbons using an oil well. In this embodiment, the hydrocarbon in a subterranean formation is contacted with an admixture of steam and a volatile amine or an admixture of a volatile amine and ammonia. The steam, volatile amine, or ammonia and volatile amine admixture is introduced downhole using either the same well used for production or other wells used to introduce the steam into the formation. Either way, the steam condenses and forms an aqueous phase which can help liberate the heavy hydrocarbon from the mineral and carry it towards the production well.

In another embodiment, the invention is a method of recovering heavy hydrocarbons, especially bitumen, where the heavy hydrocarbon is recovered from a hydrocarbon bearing ore. One such ore is the bitumen rich ore commonly known as oilsand(s) or tar sand(s).

Enormous hydrocarbon reserves exist in the form of oilsands. The asphalt-like glassy bitumen found therein is often more difficult to produce than more liquid forms of underground hydrocarbons. Oilsand bitumen does not flow out of the ground in primary production. Such ore may be mined in open pits, the bitumen separated from the mineral ex situ using at least warm water, sometimes heated with steam, in giant vessels on the surface. Or the ore can be heated with steam in situ, and the bitumen separated from the formation matrix while still underground with the water condensed from the steam.

Unlike conventional heavy crude oils, the bitumen in oilsands is not continuous but in discrete bits intimately mixed with silt or capsules encasing individual grains of water wet sand. These bituminous hydrocarbons are considerably more viscous than even conventional heavy crude oils and there is typically even less of it in the formation-even rich oilsand ores bear only 10 to 15% hydrocarbon.

One method of recovering such bitumen is to clear the earthen overburden, scoop up the ore from the open pit mine, and then use heated water to wash away the sand and silt ex situ, in a series of arduous separation steps.

A more recent process separates the hydrocarbons from the sand in situ using horizontal well pairs drilled into the deeper oilsand formations. High pressure, 500° C., dry steam is injected into an upper (injector) well, which extends lengthwise through the upper part of the oilsand deposit. The steam condenses, releasing its latent and sensible heat which melts and fluidizes the bitumen near the injector well. As the oil and water, now at about 130 to about 230° C., drains, a dry steam chamber forms above the drainage zone.

One disadvantage to this method of hydrocarbon production is that new steam, along with any additives that it may include, may have to travel ever longer distances through this porous sand and clay to reach the progressing interface between the dry steam chamber and the zone where the oil and water drainage commences (a production front). This process is known as steam assisted gravity drainage and is commonly referred to by its acronym, "SAGD."

Unlike a conventional steam drive, the pressure of the steam is not primarily used to push the oil to the producer well; rather, the latent heat of the steam is used to reduce the viscosity of the bitumen so that it drains, along with the water condensed from the steam, to the lower, producer well by gravity. Since, at the production temperature of about 150° C., pure water is about 300 times less viscous than pure bitumen, and the typically water-wet formation can't hydrophobically impede the flow of water, the water drains much faster through the formation than the melted bitumen.

Moreover, water-based (oil-in-water) emulsions flow mostly like water—they are not much more viscous than water itself. This is believed to be because the charge stabilized, oil-in-water particles are electrostatically repelled and resist rubbing against each other. Water droplets in oil, in contrast, are sterically stabilized and flow past each other only with increased friction. The result is that concentrated emulsions of water in oil can be several times more viscous than the pure oil itself. Thus, overall, a water-based emulsion can flow as much as a thousand times faster than its oil based counterpart, and so typically produce far more oil, even when it carries a lower fraction of oil.

In a typical SAGD start-up, water is the first thing out of the ground. The concentration of hydrocarbon in the production fluid increases with time until eventually the oil concentration levels out at about 25 to 35 percent of the produced fluid. Thus the limiting "steam to oil ratio" or SOR is about 2 to 3.

Whatever the condition of the fluids underground, what reaches the first phase separator on the surface may not be two bulk phases, that is, an oil-based emulsion and a water-based emulsion. Instead, the predominant emulsion is usually oil-in-water. This emulsion typically carries with it is the most bitumen it can carry without flipping states, or inverting, into a water-in-oil emulsion.

In practice then, the SOR, and thus the oil production rate, may be more limited by the fluid flux—the transfer of motion to the oil via the water flow—than the thermal flux—the transfer of heat to the oil via steam. Increasing the fraction of oil carried by the water, then, produces more oil for same steam, and is thus highly desirable.

Two advantages of the method of the invention are that the use of the amines or ammonia and amines can increase both the efficiency and the effectiveness with which heavy hydrocarbons are dispersed into (and thus carried by) water. Increased efficiency results in lower steam requirements, which results in lower energy costs. In some fields, heavy crude oil is recovered at a cost of ⅓ of the oil produced being used to generate steam. It would be desirable in the art to lower steam requirements thereby lowering the use of recovered hydrocarbons or purchased energy in the form of natural gas for producing heavy hydrocarbons. Increased effectiveness results in greater total recovery of bitumen from the formation. Less oil is left wasted in the ground. This increases the return for the fixed capital invested to produce it.

Another method of recovery of heavy hydrocarbons employs volatile hydrocarbon vapors to enhance the extraction. This "vapor extraction" method is commonly known in the art as VapEx. In this method, dilution with light hydrocarbon rather than heating with steam is used to reduce the viscosity of the heavy hydrocarbons. These methods are known in the art and may be found in U.S. Pat. No. 4,450,913 to Allen et al, and U.S. Pat. No. 4,513,819 to Islip et al, U.S. Pat. No. 5,407,009 to Butler et al, U.S. Pat. No. 5,607,016 to Butler, U.S. Pat. No. 5,899,274 to Frauenfeld et al, U.S. Pat. No. 6,318,464 to Mokrys, U.S. Pat. No. 6,769,486 to Lim et al, and U.S. Pat. No. 6,883,607 to Nenniger et al., which are incorporated herein in their entirety by reference.

As in the case with steam alone, however, merely reducing the viscosity of the heavy hydrocarbon generally will not move the oil as quickly as dispersing it into a much thinner, aqueous phase. The heavier the hydrocarbon the more this is true. In formations containing some water, the method of this invention may be used with solvent injection subject to the caveat that there is sufficient water in the formation to allow the amines or ammonia and amines to create a water-based, oil-bearing fluid to increase the efficiency and/or the effectiveness of the subject process compared to the same process practiced without the method of the present invention.

Where formation water is insufficient to allow the amines or ammonia and amines to create a water-based, oil-bearing fluid, combinations of volatile hydrocarbon diluents and steam can be used with the method of this invention. One combination process is commonly known as Light Alkane Steam Enhanced Recovery, or "LASER". The addition of steam and diluent provides an aqueous carrier phase and lowers the viscous impediment to the heavy oil dispersing into it. The method of this invention amplifies this effect by increasing the forces driving the oil into the water and keeping it there. This allows the water to carry more oil, reducing the demand for steam and the energy needed to generate it.

A further method of this invention is to use the amines or amines and ammonia as the immiscible, water-like phase. Ammonia and smaller amines like methylamine are liquids under production pressures with viscosities even less than water. For example, liquid ammonia is 100 times less viscous than water at the same temperature. A carrier fluid of liquid ammonia or a volatile, oil immiscible amine could be removed and recycled on the surface at lower temperatures than used for water.

In the practice of the method of the invention, ammonia or a single amine or a mixture of amines or a mixture of ammonia and amines may be used to enhance heavy hydrocarbon production. While any amine may be useful with the method of the invention, in one embodiment of the invention, the amine is any having a boiling point at atmospheric pressure no more than 135° C. and a $pK_a$ of at least 5.0. In another embodiment, the amine is any having a boiling point at atmospheric pressure no more than 145° C. and a $pK_a$ of at least 4.95. Exemplary amines include, but are not limited to: methyl amine, dimethyl amine, trimethyl amine, diethyl amine, ethyl amine, isopropyl amine, n-propyl amine, diethyl amine, 1,1-dimethyl hydrazine, isobutyl amine, n-butyl amine, pyrrolidone, triethylamine, methyl hydrazine, piperidine, dipropylamine, hydrazine, pyridine, ethylenediamine, 3-methoxypropylamine, N,N-diethylhydroxylamine, morpholine, pyrrole, and cyclohexylamine. Amines that have both a low boiling point and a comparatively high $pK_a$ such as dimethyl amine (BP: −1.7° C.; $pK_a$=10.68) can be desirable in some embodiments of the invention.

While not wishing to be bound by any theory, it is believed that anionic surfactants can be created in situ in the method of the invention from compounds with amine-reactive functional groups commonly found in heavy hydrocarbons. In particular, the long chain carboxylic acids generally referred to as naphthenic acids react on contact with ammonia or amines to form oil-emulsifying soaps. Thus, the amines with $pK_a$ values high enough to react and volatile enough to get to the reactive sites are useful with the method of the invention.

In some applications, it is desirable that the amines have a volatility that is sufficient to allow for their delivery to the production front though a depleted formation with dry steam. For example, the surfactants formed in situ by such a delivery may accelerate the release (or inhibit the adsorption) of bitumen encapsulating sand grains in oilsands. This release may generate stable, low viscosity, bitumen-in-water dispersions or emulsions that flow more swiftly through a water-wet sandpack. Thus, this more oil laden water accelerates the recovery of bitumen from oilsands.

In such an embodiment, the condensed water is also able to carry a higher loading of this surface-activated bitumen than non-activated bitumen. Higher carrying capacity reduces the water and thus the steam and thus the natural gas (or other energy source) needed to produce a barrel of bitumen. In such a business model, capital costs may be more quickly recovered, and operating costs are permanently reduced, all of which are clearly desirable in a commercial operation.

The amine compounds added to steam or solvent may be sufficiently volatile to be transported by the steam in the vapor phase such that it can penetrate the formation to the bitumen draining front or production front where the steam is condensing. In practice, this means that the amines boil below or not too much above the temperature of water at equal pressure. Provided the amine is sufficiently alkaline, it cannot be too volatile, since it will react with the bitumen from gas phase. Even low boiling gasses, such as ammonia, reacted with bitumen on contact, increasing the bitumen's water dispersibility.

There may in some cases be an optimum volatility which concentrates the amine by condensing it in a particular production zone.

As already stated, it is desirable for the amines to be sufficiently alkaline to react with naphthenic (carboxylic) acids in the heavy hydrocarbons to form carboxylate anions which are effective soaps. Carboxylic acids, as a class, have a $pK_a$ of from about 3.7 to about 4.9. Organic bases with conjugate acids exceeding those $pK_a$s include all common aliphatic amines (pKa 8.9-10.8) and most aromatic amines (pKa 5.2-7.0); though a few aromatic amines, such as aniline, are not strong enough bases to react with some common carboxylates. The soaps so formed in situ may, for example, enhance the release of bitumen from an oilsand and suspend the bitumen in the water condensed from the steam. The water thereby transports more bitumen to the surface.

Some hydrocarbon recovery methods employ caustic and/or carbonates as a source of base for their applications. The use of caustic and/or carbonates is not always desirable because of problems associated with the accumulation of alkali metals in the hydrocarbons being produced. In the method of the invention, the amines or ammonia and amines used may be used to replace this function, thereby overcoming the accumulation of sodium or other alkali metals in produced hydrocarbons or the recycled production water.

Once hydrocarbons are produced using the method of the invention, they may be recovered from the resultant hydrocarbon in water emulsion using any method known to be useful to those of ordinary skill in the art. For example, the emulsion may be broken using polyamine, polyether, metal hydrate, or acid based emulsion breakers or "reverse" breakers ahead of the various separation vessels.

The amines or ammonia and amines may be added to the steam and, optionally, solvent in any way known to be useful to those of ordinary skill in the art. They may be admixed in advance and injected as a single phase or mixture. They may also be co-injected. They may be used in any concentration that is useful, useful being defined as being more effective or efficient than a when an otherwise identical hydrocarbon recovery process is practiced in the absence of the method of the invention. For example, in one embodiment, amines or ammonia and amines are added at a concentration of from about 50 to about 50,000 ppm by weight in the steam or solvent. In another embodiment, amines or ammonia and amines are added at a concentration of from about 1000 to about 10,000 ppm by weight of the amine or ammonia and amine in the steam or solvent.

The hydrophilic-lipophilic balance (HLB) of the surfactants created in situ may be optimized for maximum utility on different bitumens by manipulating the alkyl groups on the amine. Oil affinity (lipophilicity) of the surfactant may be increased by increasing the number or size of hydrocarbon groups on the amine. Decreasing the number or size of hydrocarbon groups will decrease its oil affinity and increase its water affinity (hydrophilicity).

The method of the invention may be desirably practiced in the absence of other reagents, reactants, or surfactants that may be introduced from the surface. For example, the method of the invention may be practiced in the absence of materials used to modify the surface wetability or other property of the mineral in the formation, for example, to decrease the mineral's mobility or the fluid permeability though it. In particular, mineral hydrophobizing reactants such as silanes and similar silicon-based compounds and water shut off agents such as water soluble polymers or their precursors are to be avoided as detrimental to the enhanced flow of water promoted by the methods of this invention. More broadly, any additive preferentially reacting with or adsorbing onto minerals surfaces is to be avoided where the mineral surface area, for example, in oilsands with clay fines, is so many times larger than the surface area of any oil-water emulsion that it's would be grossly uneconomical.

For the purposes of this application, the term "steam" has its ordinary meaning of water vapor heated to or above the boiling point. In the art of recovering hydrocarbons from oilsands, steam is sometimes further qualified as "low quality steam" and "high quality steam." For the purposes of this application, the term "high quality steam means steam that, at the point of injection into oilsands, has at least 70% of the water in this fluid stream in the form of steam and 30% or less in the form of condensed water. In some embodiments, it is necessary that that at least 80% by weight of the water be in the form of water vapor. Any fluid stream having less than 70% water vapor is low quality steam.

In one embodiment of the invention, ammonia without an amine may be used if the steam is high quality steam. High quality steam allows ammonia to remain in the vapor state and be carried more efficiently through a heavy hydrocarbon formation.

EXAMPLES

The following examples are provided to illustrate the present invention. The examples are not intended to limit the scope of the present invention and they should not be so interpreted. Amounts are in weight parts or weight percentages unless otherwise indicated.

Example 1

A Soxhlet extraction apparatus with a Dean-Stark trap was used to measure the extent to which various alkaline materials were able to evaporate with water and then condense with the steam. Ten grams (10 g) of an oilsand ore containing about 15% bitumen was added to a stainless basket mesh net suspended at the top of a round bottom (RB) flask directly below the reflux from the trap. 200 mL of deionized water was added to the RB flask, along with 500 ppm of various chemical additives. Blanks were run in which the water was raised to pH 9-10 with NaOH, a non-volatile base. The flask was placed in a heating mantle and heated to boiling.

When the trap was full, the water condensate was sampled to measure pH (by electrometer) and surface tension (by du Noüy ring). The surface tensions were all between 66 and 72 mN/m indicating no significant surfactant effect for the additives themselves.

The pH values are listed in Tables 1 and 2. There is clear distinction between the group of volatile amine bases (Table 1) and the group of non-volatile bases and volatile non-bases (Table 2). The former evaporated with the water and condensed with the steam, raising the pH of the condensate to the 9.3-10.7 range (avg. 9.9). The latter left the pH of the condensate between 6.2 and 8.8 (avg. 7.5).

After refluxing the water in the flask for 3 hours, the heat was turned off for 30 minutes and the basket of ore removed. To measure the amount of bitumen extracted from the ore with the condensed water, the water was boiled off and removed through the trap. Toluene was added to the flask to dissolve and remove the bitumen. The toluene was then evaporated and the bitumen weighed. The basket of ore was returned to the flask and refluxed to clarity with toluene to obtain the weight of bitumen remaining in the ore. The bitumen recovered with the water reflux was then compared to the total bitumen and expressed as % Recovery. These are listed in Tables 1 & 2.

In order to better replicate the bitumen viscosity at the true production temperature of about 150° C., a small amount of heptane was added to the water. Heptane boils at about the same temperature as water and so refluxes with it onto the ore sample. A dilution of 3 volumes bitumen and 1 volume heptane has about the same 25 cP viscosity at 95° C. (the temperature of the reflux water in the test) as straight bitumen does at 150° C. So for 10 g ore with 15 wt % bitumen (density about 1.0), 0.5 mL of heptane was added. To evaluate the effect at the higher temperature at which the steam first condenses in the formation, some tests were also run with 1.0 mL of heptane added. Tables 1 & 2 lists the recoveries at each of these simulated temperatures separately (as 0, 0.5, and 1.0 mL heptane added).

For a variety of reasons, data from early tests were highly variable. A lot depended on how the condensate droplet hit and diffused through the thimble of ore to cause the bitumen to fall through a hole or drain through the sand. A good bitumen remover might drill a hole through the ore and not recover much bitumen. A poor bitumen remover might not drain before filling the thimble and dissolve a great deal in the time it was retained—and so remove more than a faster draining compound. Even if all these paradoxical results are included, however, when the entire class of volatile amines is compared to the entire class of non-volatile amines and non-amines (including NaOH adjusted blanks), it can be seen in Table 3 that there is a significant improvement in recovery with the addition of the volatile amines. With no heptane added to thin the bitumen, recovery seemed viscosity limited, but it still slightly improved from 21%±5 to 29%±3. At the higher simulated temperature from adding 0.5 mL heptane (1:3 bitumen), the improvement was from 20%±5 to 40%±17. With 1.0 mL added (2:3 bitumen), the improvement was from 37%±4 to 54%±7.

More consistent results were obtained by using a solid ceramic thimble with 5 small holes in the bottom, like an upside down salt shaker. With this thimble, the faster draining materials could not just burn a hole through the steel mesh. The 3 tests carried out in this way are summarized in Table 4. The bitumen recovery, both as a percent and as a multiple of the blank are listed. Here the effect and the trend are unmistakable. In the homologous methyl series from ammonia to trimethylamine: $NH_3$, $NH_2CH_3$, $NH(CH_3)_2$, $N(CH_3)_3$; bitumen recovery relative to the blank goes monotonically from 5.9 times more (ammonia) to 4.7 times more (methylamine) to 3.4 times more (dimethylamine) to 2.6 times more (trimethylamine) as the materials become less volatile, more hydrophobic, and weaker bases. All 3 effects may be relevant—for example, methoxypropylamine (MOPA) and hydrazine are both much less volatile then trimethylamine, but they are also less hydrophobic and stronger primary amines, like methylamine. MOPA was 3.0 better then the blank, half way between dimethyl and trimethyl amine, and hydrazine was 2.6 times better, about the same as trimethylamine.

TABLE 1

Low Condensate pH Class

| | pH Measured | | | | |
|---|---|---|---|---|---|
| | Feed | | % Recovery | | |
| Chemical used, 500 ppm active | water | Condensate | 0* | 0.5* | 1.0* |
| 1,3,5-trimethyl-1h-pyrozol-4-amine | 7.0 | 7.1 | 50 | | |
| 1,3-dimethyl-1h-pyrazol | 7.7 | 7.5 | 34 | | |
| 1,3-dimethyl-1h-pyrazol | | | | 4 | |
| Aromatic naphtha | 8.7 | 8.8 | 11 | | |
| 2-(2-Aminoethyl)pyridine | 10.0 | 8.7 | 14 | | |
| 2-(2-Aminoethyl)pyridine | | | 8 | | |
| 2-methyl-1h-indol-6-amine | 7.1 | 7.0 | 63 | | |
| 3-tert-butyl-1H-pyrazo | 7.0 | 7.8 | 57 | | |
| Blank | 9.0 | 6.2 | 24 | | |
| Blank | 9.9 | 7.2 | 2 | | |
| Blank | 9.2 | 7.0 | 38 | | |
| Blank | 8.7 | 7.0 | 4 | | |
| Blank | | | 8 | 18 | 33 |
| Blank | | | 8 | 32 | |
| Blank | | | 8 | 33 | |

TABLE 1-continued

Low Condensate pH Class

| | pH Measured | | | | |
|---|---|---|---|---|---|
| | Feed | | % Recovery | | |
| Chemical used, 500 ppm active | water | Condensate | 0* | 0.5* | 1.0* |
| ethylenediamine | 10.4 | 8.4 | 9 | | |
| ethylenediamine | | | 7 | | |
| isonipecotic acid | 6.7 | 6.7 | 53 | | |
| isonipecotic acid | | | | 15 | |
| pyridine | 10.0 | 8.3 | 6 | | 40 |
| triethanolamine | | | 3 | | |
| Mean | 8.6 | 7.5 | 21 | 20 | 37 |

*mL Heptane added

TABLE 2

High Condensate pH Class

| | pH Measured | | | | |
|---|---|---|---|---|---|
| | Feed | | % Recovery | | |
| Chemical used, 500 ppm active | water | Condensate | 0* | 0.5* | 1.0* |
| 3-methoxypropylamine | 10.3 | 10.0 | 19 | | |
| 3-methoxypropylamine | 10.5 | 9.6 | 23 | | |
| 3-methoxypropylamine | 10.6 | 10.4 | 20 | | |
| 3-methoxypropylamine | | | 29 | 52 | 40 |
| 3-methoxypropylamine | | | 25 | | |
| ammonia | 9.7 | 9.8 | 22 | | |
| ammonia | 9.7 | 9.6 | 59 | | |
| ammonia | 10.2 | 10.1 | 27 | | |
| ammonia | | | 15 | 20 | 44 |
| ammonia | | | 49 | | |
| cyclohexylamine | 10.5 | 10.7 | 7 | | |
| dimethylamine | | | 33 | 100 | |
| dimethylamine | | | 24 | | |
| dipropylamine | 10.9 | 10.1 | 56 | | |
| dipropylamine | 10.7 | 9.6 | 6 | | |
| dipropylamine | | | 10 | 10 | 64 |
| hydrazine | | | 30 | | 50 |
| methylamine | | | 44 | | 95 |
| methylamine | | | 48 | | |
| N,N-diethylhydroxylamine | 8.7 | 9.3 | 59 | | |
| piperidine | | | 32 | | 52 |
| triethylamine | | | 9 | | |
| triethylamine | | | 30 | 18 | 33 |
| trimethylamine | | | 19 | | |
| trimethylamine | | | 32 | | 50 |
| Mean | 10.2 | 9.9 | 29 | 40 | 54 |

*mL Heptane added

TABLE 3

% Bitumen Recovery by Chemical Class

| Class | Statistic | Solution pH | Condensate pH | 0 mL Heptane | 0.5 mL Heptane | 1 mL Heptane |
|---|---|---|---|---|---|---|
| Non-volatile & non-amine | mean | 8.6 | 7.5 | 21 | 20 | 37 |
| | std dev | | | 21 | 12 | 5 |
| | data pts | | | 19 | 5 | 2 |
| | std error | | | 5 | 5 | 4 |
| Volatile amines | mean | 10.2 | 9.9 | 29 | 40 | 54 |
| | std dev | | | 16 | 37 | 19 |
| | data pts | | | 25 | 5 | 8 |
| | std error | | | 3 | 17 | 7 |

TABLE 4

| Ceramic Thimble | | | | | | | | |
|---|---|---|---|---|---|---|---|---|
| | Bitumen Recovery, % | | | | Multiple to Blank | | | |
| Material | Test 3 | Test 2 | Test 1 | Avg | Test 3 | Test 2 | Test 1 | Avg |
| Heptane addition, mL | — | 1.0 | — | 0.3 | — | 1.0 | — | 0.3 |
| Blank | 8.3 | 31.8 | 7.9 | 16.0 | 1.0 | 1.0 | 1.0 | 1.0 |
| Aromatic Solvent 0.5 mL | 33.3 | | | 33.3 | 4.0 | | | 4.0 |
| Methylamine | 47.7 | 93.8 | 43.4 | 61.6 | 5.7 | 2.9 | 5.5 | 4.7 |
| Dimethylamine | 23.5 | 100.0 | 33.1 | 52.2 | 2.8 | 3.1 | 4.2 | 3.4 |
| Trimethylamine | 18.9 | 49.6 | 31.9 | 33.5 | 2.3 | 1.6 | 4.0 | 2.6 |
| Ammonia | 48.9 | | | 48.9 | 5.9 | | | 5.9 |
| 3-methoxypropylamine | 25.4 | | | 25.4 | 3.0 | | | 3.0 |
| Hydrazine | | 50.4 | 28.8 | 39.6 | | 1.6 | 3.6 | 2.6 |
| Piperidine | | 54.2 | 31.5 | 42.8 | | 1.7 | 4.0 | 2.9 |
| Pyridine (low pH Condnst) | | 38.9 | 6.3 | 22.6 | | 1.2 | 0.8 | 1.0 |

What is claimed is:

1. A method for producing a hydrocarbon comprising contacting a heavy hydrocarbon from a subterranean formation, in situ, with steam and a volatile amine wherein an anionic surfactant is formed in situ by contact of the volatile amine with the heavy hydrocarbon, and the volatile amine includes an alkyl group or groups, and the alkyl group or groups are selected such that a hydrophilic-lipophilic balance (HLB) of the surfactants created in situ is optimized for maximum utility in recovering the heavy hydrocarbons.

2. The method of claim 1 wherein the heavy hydrocarbon is a dense or high viscosity crude oil and/or bitumen.

3. The method of claim 2 wherein the heavy hydrocarbon is an oil sand.

4. The method of claim 1 wherein the amine has an atmospheric pressure boiling point of less than or equal to 145° C.

5. The method of claim 4 wherein the amine has an atmospheric pressure boiling point of less than or equal to 135° C.

6. The method of claim 1 wherein the amine has a $pK_a$ of at least 4.95.

7. The method of claim 6 wherein the amine has a $pK_a$ of at least 5.0.

8. The method of claim 1 wherein the amine is selected from the group consisting of methyl amine, dimethyl amine, trimethyl amine, diethyl amine, ethyl amine, isopropyl amine, n-propyl amine, diethyl amine, 1,1-dimethyl hydrazine, isobutyl amine, n-butyl amine, pyrrolidone, triethylamine, methyl hydrazine, piperidine, dipropylamine, hydrazine, pyridine, ethylenediamine, 3-methoxypropylamine, N,N-diethylhydroxylamine, morpholine, pyrrole, cyclohexylamine and combinations thereof.

9. The method of claim 1 wherein the subterranean formation is a depleted formation.

10. The method of claim 9 wherein the amine has a volatility that is sufficient to allow for delivery of the amine to a production front.

11. The method of claim 1 further comprising using a volatile solvent vapor.

12. The method of claim 1 wherein the amine or ammonia and amine is added to the steam at a concentration of from about 50 to 50,000 ppm by weight of the amine or ammonia and amine in the steam.

13. The method of claim 12 wherein the amine or ammonia and amine is added to the steam at a concentration of from about 1,000 to 10,000 ppm by weight of the amine or ammonia and amine in the steam.

14. The method of claim 1 wherein the hydrocarbon is contacted with steam and an amine in-situ.

15. A heavy hydrocarbon recovered from an underground formation resulting from contacting a heavy hydrocarbon from a subterranean formation, in situ, with a solvent vapor, steam, and a volatile amine or ammonia and a volatile amine wherein an anionic surfactant is formed in situ by contact of the volatile amine with the heavy hydrocarbon, and the volatile amine includes an alkyl group or groups, and the alkyl group or groups are selected such that a hydrophilic-lipophilic balance (HLB) of the surfactants created in situ is optimized for maximum utility in recovering the heavy hydrocarbons.

16. A method for producing a hydrocarbon comprising contacting a heavy hydrocarbon from a subterranean formation, in situ, with high quality steam and ammonia wherein an anionic surfactant is formed in situ by contact of the volatile amine with the heavy hydrocarbon, and the volatile amine includes an alkyl group or groups, and the alkyl group or groups are selected such that a hydrophilic-lipophilic balance (HLB) of the surfactants created in situ is optimized for maximum utility in recovering the heavy hydrocarbons.

* * * * *